US006259008B1

(12) United States Patent
Eddinger et al.

(10) Patent No.: US 6,259,008 B1
(45) Date of Patent: Jul. 10, 2001

(54) DOUBLE-ACTION TRUSS ROD FOR STRINGED INSTRUMENTS

(76) Inventors: Steven W. Eddinger; Darlene F. Eddinger, both of 8850 Mill Creek Rd., Healdsburg, CA (US) 95448

( * ) Notice: Subject to any disclaimer, the term of this patent is extended or adjusted under 35 U.S.C. 154(b) by 0 days.

(21) Appl. No.: 09/492,258

(22) Filed: Jan. 27, 2000

Related U.S. Application Data

(60) Provisional application No. 60/117,495, filed on Jan. 27, 1999.

(51) Int. Cl.[7] ..... G10D 5/00
(52) U.S. Cl. ..... 84/293; 84/267
(58) Field of Search ..... 84/293, 267, 314 R

(56) References Cited

U.S. PATENT DOCUMENTS 4,074,606 * 2/1978 Fender ..... 84/293
4,084,476 * 4/1978 Rickard ..... 84/293
4,111,093 * 9/1978 Field et al. ..... 84/267
4,172,405 * 10/1979 Kaman ..... 84/293
4,237,944 * 12/1980 Todd, III et al. ..... 144/316
4,528,886 * 7/1985 Fender ..... 84/293
4,557,174 * 12/1985 Gresset, Jr. ..... 84/293
4,852,449 * 8/1989 Zeitler ..... 84/293
5,249,498 * 10/1993 Wilfer et al. ..... 84/293
5,465,642 * 11/1995 Goto ..... 84/293
5,965,830 * 10/1999 Carlson ..... 84/293
5,973,242 * 10/1999 Spezia ..... 84/290

* cited by examiner

*Primary Examiner*—Robert E. Nappi
*Assistant Examiner*—Kim Lockett
(74) *Attorney, Agent, or Firm*—Johnson & Stainbrook, LLP; Larry D. Johnson; Craig M. Stainbrook

(57) ABSTRACT

A truss rod for selectively bowing the neck of a stringed instrument includes a segment of round stock having a pair of threaded ends, one set of threads in a first thread direction, and the other set of threads in the reverse direction. Complementary threaded blocks are threaded onto these threaded ends, and the blocks are secured to a length of flat bar stock. A head bearing a socket is fixed to an end of the round stock, so that turning of the head turns the round stock. The reversed nature of the respective threaded ends causes the length of the portion of the round stock between the fixed blocks to either increase or decrease when the round stock is turned, which correspondingly causes the flat bar to bend either in or out.

6 Claims, 1 Drawing Sheet

DOUBLE-ACTION TRUSS ROD FOR STRINGED INSTRUMENTS

The present application claims the benefit of the filing date of U.S. Provisional Application Ser. No. 60/117,495, filed Jan. 27, 1999, by applicants herein.

BACKGROUND OF THE INVENTION

1. Field of the Invention

This invention relates generally to truss rods for stringed instruments such as guitars and mandolins, and more specifically to an improved double-action truss rod enabling true two-way adjustment.

2. Description of the Prior Art

A truss rod (also known as an internal stiffener) may be installed into a channel in the neck of a stringed instrument to counteract forward warp or bow caused, e.g., by string tension. Prior art truss rods typically utilize parallel segments of square bar and round bar, welded together at one end, and fitted with a threaded nut on the other end of the round bar adjacent a fixed block on the other end of the square bar so that turning of the nut causes the relative length of one side of the truss to shorten, thereby bending the truss and therefore the neck of the instrument. However, in this structural arrangement, the truss rod bends in one direction only, thereby limiting the possible adjustments that can be made to the neck of the instrument.

SUMMARY OF THE INVENTION

The double-action truss rod for stringed instruments of this invention provides an improved truss rod for selectively bowing the neck of a stringed instrument. The inventive truss rod includes a segment of round stock having a pair of threaded ends, one set of threads in a first thread direction, and the other set of threads in the reverse thread direction. Complementary threaded blocks are threaded onto these threaded ends, and the blocks are welded or otherwise secured to a length of flat or square bar stock. A head bearing a socket is fixed to an end of the round stock, so that turning of the head turns the round stock. The reversed nature of the respective threaded ends causes the length of the portion of the round stock between the fixed blocks to either increase or decrease when the round stock is turned, which correspondingly causes the flat bar to bend either in or out.

The double-action truss rod of this invention thus provides an adjustable truss rod fabricated from metal inside the neck shaft of a stringed instrument. A small amount of give inside the instrument's neckshaft results in better playability with an adjustable truss rod that can be tightened and loosened to adjust and control the neck's response to string tension.

By incorporation of the right-hand threads on one end of the threaded rod, and left-hand threads on the other end, turning of the Allen socket causes the rod to either shorten or lengthen relative to the flat bar, thereby selectively bowing the bar (and thus the neck of the instrument) either inward or outward.

DETAILED DESCRIPTION OF A PREFERRED EMBODIMENT

Figure 1:
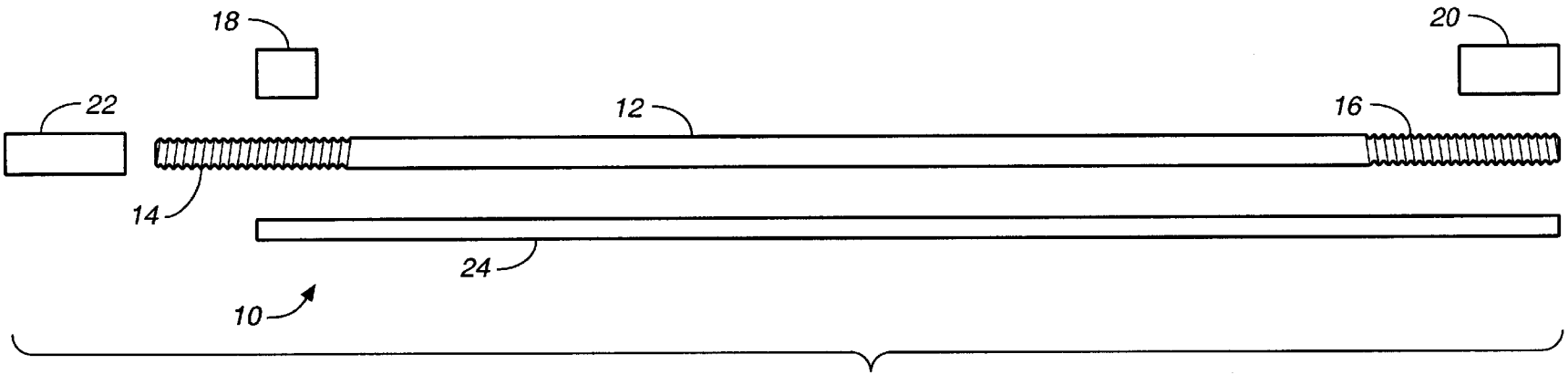
FIG. 1 is an exploded view of the double-action truss rod of this invention.

FIG. 1 is an exploded view of the truss rod of this invention. Truss rod 10 includes a segment of round stock 12 of suitable dimensions (e.g., approximately three-sixteenth inch diameter and fourteen inches long for steel string guitars, seventeen inches long for electric guitars, and twenty-four inches long for bass guitars), and having a pair of threaded ends 14, 16. First end 14 is threaded in a first direction, e.g., 10/32 NF left hand threads approximately one and-a-half inches in length, while second end 16 is threaded in the opposite direction, e.g., 10/32 NF right hand threads approximately one inch in length. First threaded block 18 (e.g., one-quarter inch by one-quarter inch by three-eighths inch long) bears left hand threads complementary to first end 14, while second threaded block 20 (e.g., one-quarter inch by one-quarter inch by five-eights inch long) bears right hand threads complementary to second end 16. Head 22 may be made from one-quarter inch round stock three-quarter inches long, with a 5/64 Allen socket or other tool-engageable feature in its distal end. Fixed bar 24 may be made of flat or square bar stock (e.g., one-eighths inch by one-quarter inch, of variable length).

Figure 2:
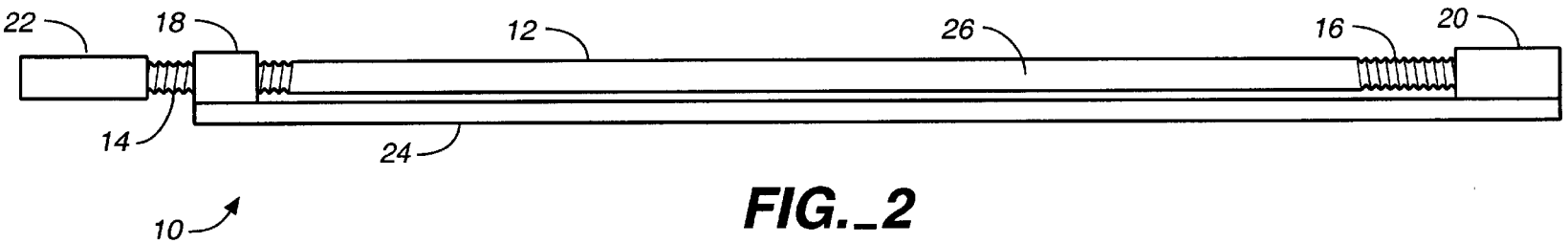
FIG. 2 is an assembled view of the double-action truss rod of FIG. 1.

FIG. 2 illustrates the truss rod of this invention as assembled. First threaded block 18 is threaded onto threaded end 14, second threaded block 20 is threaded onto threaded end 16, and the blocks are TIG welded or otherwise fixed to the corresponding ends of fixed bar 24. Head 22 is then itself welded or otherwise fixed to end 14 of round stock 12. A segment of one-quarter inch shrink tube 26 or other material may be positioned over the round stock between the threads to prevent the rod's resonant frequency from generating unwanted sounds. The truss rod can then be installed into a channel routed into the neck of the stringed instrument. The truss rod is preferably installed into the neck of the stringed instrument so that the square bar stock bears against the bottom of the finger board. With the nut actually welded onto the adjusting rod, turning the nut one way turns the rod in the same direction to bow the neck either in or out, as necessary.

While this invention has been described in connection with preferred embodiments thereof, it is obvious that modifications and changes therein may be made by those skilled in the art to which it pertains without departing from the spirit and scope of the invention. Accordingly, the scope of this invention is to be limited only by the appended claims.

What is claimed is:

1. A truss rod for selectively bowing the neck of a stringed instrument, said truss rod comprising:

a segment of round stock having a pair of threaded ends, one set of threads in a first thread direction, and the other set of threads in the reverse thread direction;

complementary threaded blocks threaded onto said threaded ends;

a length of bar stock secured to said threaded blocks; and a head fixed to an end of said round stock, said head bearing a socket, so that turning of said head turns said round stock, and the reversed nature of the respective threaded ends of said round stock causes the portion of said round stock between said threaded blocks to either increase or decrease in length when said round stock is turned, and causes said bar stock to bend.

2. The truss rod of claim 1 wherein said bar stock comprises flat bar stock.

3. The truss rod of claim 1 wherein said round stock bears a segment of material to prevent said truss rod's resonant frequency from generating unwanted sounds.

4. A truss rod for selectively bowing the neck of a stringed instrument, said truss rod comprising:

a segment of round stock having a pair of threaded ends, one set of threads in a first thread direction, and the other set of threads in the reverse thread direction, said segment of round stock bearing a segment of material to prevent said truss rod's resonant frequency from generating unwanted sounds;

complementary threaded blocks threaded onto said threaded ends;

a length of bar stock secured to said threaded blocks; and a head fixed to an end of said round stock, so that turning of said head turns said round stock, and the reversed nature of the respective threaded ends of said round stock causes the portion of said round stock between said threaded blocks to either increase or decrease in length when said round stock is turned, and causes said bar stock to bend.

5. The truss rod of claim 4 wherein said bar stock comprises flat bar stock.

6. The truss rod of claim 4 wherein said head bears a socket.

* * * * *